US011536430B2

(12) United States Patent
Quadri et al.

(10) Patent No.: US 11,536,430 B2
(45) Date of Patent: Dec. 27, 2022

(54) LIGHT FIXTURE AND METHOD FOR OPERATING SAID LIGHT FIXTURE

(71) Applicants: OSRAM GmbH, Munich (DE); CLAY PAKY S.p.A., Seriate (IT)

(72) Inventors: Aris Quadri, Seriate (IT); Andreas Huber, Maisach (DE); Alberto Alfier, Vedelago (IT)

(73) Assignees: OSRAM GMBH, Munich (DE); CLAY PAKY S.P.A., Seriate (IT)

( * ) Notice: Subject to any disclaimer, the term of this patent is extended or adjusted under 35 U.S.C. 154(b) by 300 days.

(21) Appl. No.: 16/831,847

(22) Filed: Mar. 27, 2020

(65) Prior Publication Data

US 2020/0309335 A1 Oct. 1, 2020

(30) Foreign Application Priority Data

Mar. 29, 2019 (IT) ..... 102019000004799

(51) Int. Cl.

| | |
|---|---|
| ***F21S 10/02*** | (2006.01) |
| ***H05B 47/175*** | (2020.01) |
| ***F21V 21/30*** | (2006.01) |
| ***F21V 23/00*** | (2015.01) |
| *F21W 131/406* | (2006.01) |

(52) U.S. Cl.

CPC ..... *F21S 10/026* (2013.01); *F21S 10/023* (2013.01); *F21V 21/30* (2013.01); *F21V 23/003* (2013.01); *H05B 47/175* (2020.01); *F21W 2131/406* (2013.01)

(58) Field of Classification Search

CPC ..... F21S 10/026; F21S 10/023; F21V 21/30; F21V 23/003; F21W 2131/406; H05B 47/175

See application file for complete search history.

(56) References Cited

FOREIGN PATENT DOCUMENTS

| | | | | |
|---|---|---|---|---|
| EP | 3328165 | A1 | 5/2018 | |
| FR | 2981432 | A1 | 4/2013 | |
| WO | 2011131200 | A1 | 10/2011 | |
| WO | WO-2011131200 | A1 * | 10/2011 | ..... F21S 10/023 |

OTHER PUBLICATIONS

Italian Search Report issued for corresponding IT-Application No. 102019000004799, dated Dec. 9, 2019, 8 pages (for informational purpose only).

* cited by examiner

*Primary Examiner* — Anne M Hines

(74) *Attorney, Agent, or Firm* — Viering, Jentschura & Partner mbB

(57) ABSTRACT

A light fixture may include a casing and a support assembly configured to support and move the casing. The light fixture may include a light source assembly housed inside the casing and configured to generate visible light radiation of different colours. The light fixture may further include a control device configured to control the light source assembly based on the position or the movement of the casing or based on a parameter correlated to the position or the movement of the casing.

15 Claims, 2 Drawing Sheets

LIGHT FIXTURE AND METHOD FOR OPERATING SAID LIGHT FIXTURE

CROSS-REFERENCE TO RELATED APPLICATIONS

This Patent Application claims priority from Italian Patent Application No. 102019000004799 filed on Mar. 29, 2019, the entire disclosure of which is incorporated herein by reference.

TECHNICAL FIELD

This invention relates to a light fixture, such as a light fixture for stage, and a method for operating said light fixture.

BACKGROUND ART

Light fixtures are used in the entertainment industry to create stage effects using light beams.

The entertainment industry is always looking for new stage effects that can be obtained by means of light fixtures that are increasingly powerful and high performing and, at the same time, easy and economical to produce.

SUMMARY

In accordance with these purposes, a light fixture, such as a light fixture for stage, may be able to generate new stage effects and which, at the same time, is high performing and easy and economical to produce.

In accordance with these purposes, a light fixture may include:

- a casing;
- a support assembly configured to support and move the casing and to enable the casing to rotate about a first axis and a second axis, which is orthogonal to the first axis;
- at least one light source assembly housed inside the casing and configured to generate visible light beams of different colours;
- a control device configured to control the position of the casing via the adjustment of the support assembly and to control the colour of the beam emitted by the light source assembly based on the position or the movement of the casing or based on a parameter correlated to the position or the movement of the casing.

Thanks to this type of light source assembly control, it is possible to obtain innovative stage effects. In particular, it is possible to produce a light beam that changes colour during movement. For example, it is possible to project a beam wherein a gradual variation in colour or a variation in colours with a "rainbow" effect is perceptible during the movement of the casing (and, therefore, of the beam itself). Additional innovative stage effects can be achieved by synchronising the change in beam colour with certain movements carried out by the casing.

The effect combinations that can be achieved are countless and can be modified simply by controlling the light source assembly without the need to include specific devices within the light fixture, which would increase its size and cost.

According to a non-limiting embodiment, the control device is configured to control the colour of the beam emitted by the light source assembly based on the position or movement signals of the support assembly.

In this way, the control device is able to adjust the beam colouring quickly, achieving surprising stage effects that are synchronised with the movement of the casing.

According to a non-limiting embodiment, the light source assembly comprises at least two light sources, which are configured to generate visible light radiation of different colours.

According to a non-limiting embodiment, the support assembly comprises a base and a fork; the fork being coupled to the base so that it rotates about the first axis and the fork supporting the casing so that it rotates about the second axis. In this way, the casing (and the emitted beam) has a wide freedom of movement.

According to a non-limiting embodiment, the control device is configured to control at least one of the light sources of the light source assembly based on the position or movement of the casing or based on a parameter correlated to the position or movement of the casing.

According to a non-limiting embodiment, the control device is configured to control the activation of each light source and/or the intensity of the light radiation emitted by each light source. In this way, it is possible to obtain beams wherein the light intensity and the colour of the beam can be adjusted as desired. This enables stage effects to be achieved wherein the projected beam has particular colour effects that are synchronised with the movement of the light beam.

According to a non-limiting embodiment, the control device can also be managed remotely.

It is also possible to provide a method for operating a light fixture in order to generate particular and innovative stage effects.

BRIEF DESCRIPTION OF THE DRAWINGS

Further advantageous embodiments and developments of the component emerge from the various embodiments described below in conjunction with the figures.

Elements which are the same or of the same type, or which have the same effect, are provided with the same references in the figures.

The figures are respectively schematic representations and therefore not necessarily true to scale. Rather, relatively small elements, and in particular layer thicknesses, may be represented exaggeratedly large for illustration.

DETAILED DESCRIPTION

Figure 1:
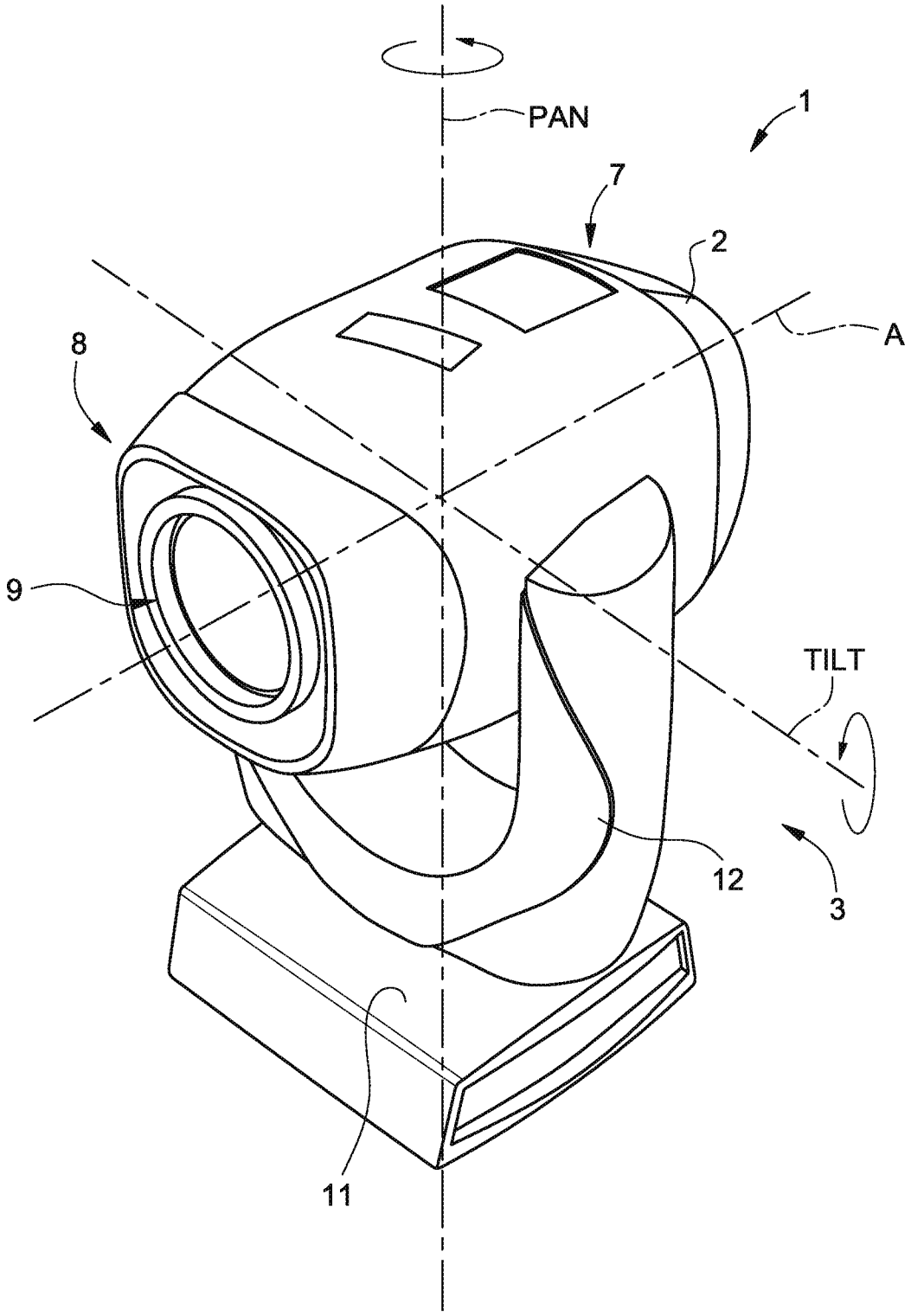
FIG. 1 is a perspective view of a light fixture.

In FIG. 1, the reference number 1 indicates a light fixture, such as for stage.

Figure 2:
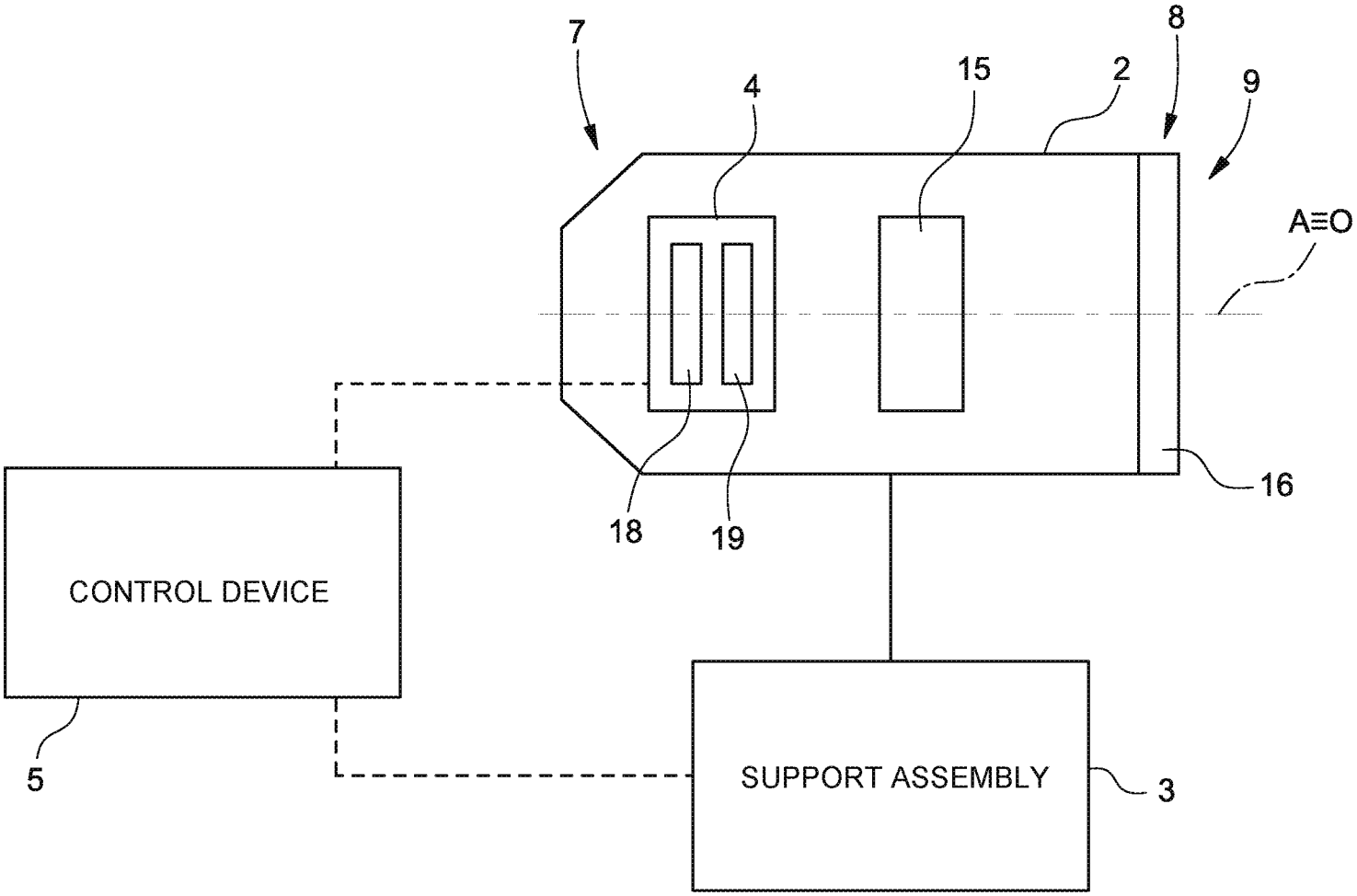
FIG. 2 is a schematic representation, with some parts shown in cross-section and some parts removed for clarity, of the light fixture in FIG. 1.

The light fixture 1 comprises a casing 2 and a support assembly 3 configured to support the casing 2, a light source assembly 4 (only visible in FIG. 2) housed inside the casing 2 and a control device 5 (only visible in FIG. 2).

The casing 2 extends along a longitudinal axis A and is provided with a first closed end 7 and a second end 8, opposite the first closed end 7 along the axis A, and provided with a projection hole 9. In the non-limiting example described and shown herein, the projection hole 9 has a substantially circular cross-section.

The support assembly 3 is configured to support and move the casing 2.

In the industry, the casing 2 is often referred to as the "moving head" due to the presence of the support assembly 3.

The support assembly 3 is configured to enable the casing 2 to rotate about two orthogonal axes, commonly known as PAN and TILT.

In particular, the support assembly 3 comprises a base 11 and a fork 12. The fork 12 is coupled to the base 11 so that it rotates about the PAN axis. The fork 12 supports the casing 2 so that it rotates about the TILT axis.

The actuation of the support assembly 3 is adjusted by the control device 5 as we will see in detail below.

With reference to FIG. 2, the light fixture 1 is provided with at least one beam processing assembly 15 and at least one optical assembly 16, which are housed inside the casing 2.

The light source assembly 4 is located inside the casing 2 at the closed end 7 of the casing 2. The beam processing assembly 15 is located between the light source assembly 4 and the optical assembly 16.

The optical assembly 16 is a lens optical assembly, such as located at the projection hole 9 so as to be a final output optical assembly.

The light source assembly 4, the beam processing assembly 15 and the optical assembly 16 are schematically represented in FIG. 2.

The light fixture 1 also comprises a frame (not visible in the attached figures) that is integral with the casing 2 and is provided with a plurality of elements coupled to one another and configured to define a support structure for the components located within the casing 2, namely the light source assembly 4, the beam processing assembly 15, and the optical assembly 16.

The light source assembly 4 is configured to generate a light beam.

The light source assembly 4 is configured to generate light beams of different colours (i.e. light beams with different emission spectra). In the non-limiting example described and shown herein, the light source assembly 4 comprises a plurality of light sources 18 (schematically represented with a block), at least two of which are configured to generate visible light radiation of different colours.

In other words, at least two light sources 18 are configured to generate light beams that have different emission spectra.

In the non-limiting example described and shown herein, there are three light sources 18 and they are RGB (Red Green Blue) sources.

The light sources 18 can be of the LED type or they may comprise laser diodes of different colours.

According to one variant, the light source assembly 4 may also comprise at least one LARP (Laser Activated Remote Phosphor) type source connected to a phosphor wheel to enable the colour of the light radiation emitted by the LARP source to be varied.

Other variants require that the light source assembly 4 comprise halogen or discharge lamps.

The light source assembly 4 comprises, in addition, an optical device 19 located downstream of the light sources 18 along the emission direction so as to intercept the light radiation emitted by the light sources 18 and is configured to conveniently process the light radiation emitted by the light sources 18 and to generate a single light beam along an optical axis O. In more detail, the optical device 19 is configured to process at least a portion of the light radiation emitted by the light sources 18 so as to form a light beam extending substantially along the optical axis O.

The optical device 19 is configured to concentrate the beam on a given point (called the point of focus).

In the non-limiting example described and shown herein, the optical axis O coincides with the longitudinal axis A of the casing 2.

The optical device 19 may comprise optical assemblies such as zoom, focus, filters, polarisers, condensers, or mixers, etc.

Each of the light sources 18 is adjustable independently of the control device 5. As we will see in detail below, the control device 5 can adjust the light source assembly 4 based on the position or movement of the casing 2.

In particular, the control device 5 may adjust the activation of each source 18 and/or the intensity of the light radiation emitted by each source 18 and/or the modulation of the light radiation emitted by each source 18 and/or the colour of the light radiation emitted by each source 18 and/or the duty-cycle of each light source 18 and/or the polarisation of the radiation emitted by each light source 18.

The control device 5 may also adjust parameters and elements of the optical device 19 located downstream of the light sources 18.

The control device 5 may also make adjustments to one light source 18 correlated to the conditions of at least one other light source 18 of the light source assembly 4. For example, the control device 5 may make adjustments based on position relationships or curves defined by the International Commission on Illumination (Commission Internationale de l'Éclairage, CIE) and/or on the complementary of colours emitted by the light sources 18.

The beam processing assembly 15 is located downstream of the light source assembly 4 and comprises at least one beam processing element that is configured to process the light beam emitted by the light source assembly 4 so as to achieve one or more stage effects. In particular, the beam processing element is supported and/or configured so as to selectively intercept the light beam in order to only modify the light beam when needed.

The beam processing assembly 15 may include a plurality of beam processing elements.

The position of each of the beam processing elements is adjusted by the control device 5.

The beam processing assembly 15 may comprise one or more gobos devices and/or a frost assembly and/or a prismatic element and/or an optical assembly and/or a zoom device, etc.

It is understood that the beam processing assembly 15 may comprise additional beam processing elements that are not listed here.

The control device 5 is configured to control the light sources 18 based on the position of the casing 2 or based on the movement of the casing 2 (e.g. based on the speed and/or acceleration of the casing 2).

In the non-limiting example described and shown herein, the control device 5 is configured to control the light sources 18 based on the movement of the casing 2 about the PAN and/or about the TILT axis.

In other words, the control device 5 is configured to control the light sources 18 based on the position or movement signals of the support assembly 3.

Normally the position signals are imparted to the support assembly 3 in a controlled way thanks to macros stored and activated automatically, or under the manual control of an operator through a remote interface (normally a console).

As already mentioned, the control device 5 is able to adjust the activation and intensity of the light radiation emitted by the light sources 18.

The control device 5 may also be managed remotely, such as using the DMX protocol communications.

The independent control of the light sources 18, according to the position of the casing 2, advantageously enables innovative stage effects to be achieved.

The position of the casing 2 is, in fact, indicative of the position of the light beam coming out of the projection hole 9.

It is possible, therefore, to produce beams that change colour and intensity during movement.

It is also possible to project a beam wherein a gradual variation in colour or a variation in colours with a "rainbow" effect is perceptible during the movement of the casing 2 (and, therefore, of the beam itself).

Special stage effects can be achieved by synchronising the change in beam colour with certain movements carried out by the casing 2.

High speed casing 2 movement can also take advantage of the persistence of the retinal image to achieve special stage effects.

Lastly, it is clear that modifications and variations may be made to the light fixture and method described herein without departing from the scope of the appended claims.

The invention claimed is:

1. A light fixture comprising:

a casing;

a support assembly configured to support and move the casing and to enable the casing to rotate about a first axis and about a second axis, which is orthogonal to the first axis;

at least one light source assembly housed inside the casing and configured to generate visible light beams of different colors;

a control device configured to control the position of the casing via the adjustment of the support assembly and to control the color of the beam emitted by the light source assembly based on the position or the movement signals of the support assembly.

2. The light fixture according to claim 1, wherein the light source assembly comprises at least two light sources configured to generate visible light radiation of different colors.

3. The light fixture according to claim 1, wherein the support assembly comprises a base and a fork; wherein the fork is coupled to the base in a rotatable manner about the first axis; and wherein the fork is configured to support the casing in a rotatable manner about the second axis.

4. The light fixture according to claim 1, wherein the control device is configured to control at least one of the at least two light sources of the light source assembly based on the position or the movement of the casing or based on a parameter correlated to the position or the movement of the casing.

5. The light fixture according to claim 4, wherein the control device is configured to control the activation of each light source of the at least two light sources.

6. The light fixture according to claim 4, wherein the control device is configured to control the intensity of the light radiation emitted by each light source of the at least two light sources.

7. The light fixture according to claim 1, wherein the control device is configured to be remotely managed.

8. The light fixture according to claim 1, wherein the casing is configured to emit a single light beam from the visible light beams of different colors generated from the at least one light source assembly.

9. A method for operating a light fixture; wherein the light fixture is provided with a casing, with a support assembly configured to support the casing and to enable the casing to rotate about a first axis and about a second axis, which is orthogonal to the first axis, of at least one light source assembly housed inside the casing and configured to generate visible light beams of different colors; wherein the method comprises:

controlling the movement of the casing via the adjustment of the support assembly; and controlling the color of the beam emitted by the light source assembly based on the position or the movement signals of the support assembly.

10. The method according to claim 9, wherein the light source assembly comprises at least two light sources configured to generate visible light radiation of different colors; wherein controlling the light source assembly comprises controlling at least one light source of the at least two light sources based on the position or the movement of the casing or based on a parameter correlated to the position or the movement of the casing.

11. The method according to claim 10, wherein controlling at least one light source of the at least two light sources comprises controlling the activation of each light source.

12. The method according to claim 10, wherein controlling at least one light source of the at least two light sources comprises controlling the intensity of the light radiation emitted by each light source.

13. A computer program configured to perform the steps of the method as claimed in claim 9.

14. A non-transitory computer readable medium having stored thereon instructions that, when executed by a processor, cause the processor to perform the method as claimed in claim 9.

15. The method according to claim 9, wherein the casing is configured to emit a single light beam from the visible light beams of different colors generated from the at least one light source assembly.

* * * * *